US011273850B2

(12) United States Patent
Anderson et al.

(10) Patent No.: US 11,273,850 B2
(45) Date of Patent: Mar. 15, 2022

(54) AUTO-RACK RAILROAD CAR BRIDGE PLATE AND BRIDGE PLATE LOCKING ASSEMBLY

(71) Applicant: Standard Car Truck Company, Rosemont, IL (US)

(72) Inventors: John D. Anderson, Oswego, IL (US); Walter J. Peach, Montgomery, IL (US)

(73) Assignee: Standard Car Truck Company, Rosemont, IL (US)

( * ) Notice: Subject to any disclaimer, the term of this patent is extended or adjusted under 35 U.S.C. 154(b) by 330 days.

(21) Appl. No.: 16/430,991

(22) Filed: Jun. 4, 2019

(65) Prior Publication Data

US 2020/0385030 A1 Dec. 10, 2020

(51) Int. Cl.
*B61D 3/18* (2006.01)

(52) U.S. Cl.
CPC ..... *B61D 3/187* (2013.01)

(58) Field of Classification Search
CPC ..... E05B 63/125; E05B 63/126; B61D 3/187; B61D 3/18; Y10S 292/27; Y10T 16/527; Y10T 16/5275; Y10T 16/528; Y10T 16/5285
See application file for complete search history.

(56) References Cited

U.S. PATENT DOCUMENTS 951,518 A 3/1910 Welch et al.
1,040,529 A 10/1912 Douglas
1,160,587 A 11/1915 Fallon
1,851,539 A 3/1932 Fitch et al.
2,788,751 A 4/1957 Russell
3,001,266 A 9/1961 Kilbane et al.
3,003,167 A 10/1961 Smith
3,004,500 A 10/1961 Johnson
3,094,946 A 6/1963 Bain et al.
3,161,153 A 12/1964 Johnson
3,195,478 A 7/1965 Thompson
3,203,364 A 8/1965 Gutridge
3,216,372 A 11/1965 Boone
3,216,373 A 11/1965 Boone
3,228,355 A 1/1966 Black
3,257,972 A 6/1966 Boone et al.
3,323,472 A 6/1967 Boone et al.
3,327,650 A 6/1967 Frederick et al.
3,351,024 A 11/1967 Broling
(Continued)

OTHER PUBLICATIONS

US 6,435,104 B1, 08/2002, Forbes (withdrawn)
(Continued)

*Primary Examiner* — Mark T Le
(74) *Attorney, Agent, or Firm* — McCoy Russell LLP

(57) ABSTRACT

An auto-rack bridge plate locking assembly including a support bracket, a guide tube, a slidable locking pin partially positioned in the guide tube, a handle assembly removably attachable to the locking pin, a fixed pivot pin partially positioned in the guide tube, and a spring positioned in the guide tube between the pivot pin and the locking pin. An auto-rack railroad car bridge plate may include a plate configured to extend from one auto-rack railroad car to an adjacent auto-rack railroad car with the locking assembly connected to the plate and configured to pivotally attach the plate to one of the auto-rack rail road cars.

21 Claims, 15 Drawing Sheets

(56) References Cited

U.S. PATENT DOCUMENTS 3,421,454 A 1/1969 Connerat
3,521,576 A 7/1970 Murray
3,521,577 A 7/1970 Akers
3,556,020 A 1/1971 Akers
3,572,254 A 3/1971 Slager
4,191,107 A 3/1980 Ferris et al.
4,667,604 A 5/1987 Baker
4,677,918 A 7/1987 Baker et al.
4,686,909 A 8/1987 Burleson
4,721,426 A 1/1988 Bell et al.
5,125,695 A * 6/1992 Hartwell ..... E05B 15/101 292/62
5,515,792 A 5/1996 Bullock et al.
5,535,681 A 7/1996 Sarnicki et al.
5,575,222 A 11/1996 Sauer et al.
5,596,936 A 1/1997 Bullock
5,618,066 A * 4/1997 Fu-Hsiang ..... E05B 47/0009 292/62
5,657,698 A 8/1997 Black et al.
5,782,187 A 7/1998 Black et al.
5,845,584 A 12/1998 Bullock
5,851,084 A * 12/1998 Nishikawa ..... F16D 1/0864 403/344
6,463,688 B1 * 10/2002 Idehara ..... F41A 19/54 42/1.16
6,539,878 B1 4/2003 Coslovi et al.
6,550,399 B1 4/2003 Coslovi et al.
6,550,400 B1 4/2003 Forbes
6,857,376 B2 2/2005 Coslovi et al.
7,255,047 B1 8/2007 Coslovi et al.
2006/0102045 A1 5/2006 Larsen et al.
2007/0022899 A1 2/2007 Burt et al.
2009/0304481 A1 12/2009 Larsen et al.
2017/0334463 A1 * 11/2017 Anderson ..... B61D 3/187

OTHER PUBLICATIONS

"Pictures of Bridge Plate Hinge", Michigan Scientific Transportation Products, LLC, available prior to May 20, 2016 (15 pages).
"Pictures of bridge plate locking assemblies", available prior to May 20, 2016 (8 pages).

* cited by examiner

AUTO-RACK RAILROAD CAR BRIDGE PLATE AND BRIDGE PLATE LOCKING ASSEMBLY

BACKGROUND

The railroad industry employs a variety of auto-rack railroad cars for transporting newly-manufactured vehicles such as automobiles, vans, and trucks. Auto-rack railroad cars, known in the railroad industry as auto-rack cars, often travel thousands of miles through varying terrain. Auto-rack cars can have one deck, and often are compartmented, having two or three decks. Newly manufactured vehicles are loaded into and unloaded from an auto-rack car for transport by one or more persons (each sometimes called a "loader") who drive the vehicles into or out of the auto-rack car.

One problem relating to auto-rack cars involves the bridge plates used to load and unload a string or series of connected or coupled auto-rack cars. Prior to loading or unloading the string or series of connected or coupled auto-rack cars, the doors of the auto-rack cars are opened and bridge plates are positioned in the gaps between each of the adjacent auto-rack cars. In other words, each gap between each pair of adjacent decks of adjacent auto-rack cars is spanned by a pair of portable removable bridge plates to load the vehicles. The vehicles are loaded in the auto-rack cars by driving the vehicles into one end of the string or series of connected or coupled auto-rack cars, over the bridge plates and through the adjacent cars until all of the auto-rack cars in the series or string are filled. The vehicles are driven into the first auto-rack car on either the first, second, or third deck (depending upon the type and size of auto-rack car and the vehicle). One deck or level at a time is typically loaded, and then the bridge plates are moved downwardly or upwardly to load the next deck or level. This process is reversed for unloading the vehicles from the string or series of connected or coupled auto-rack cars.

Each pair of bridge plates supports the vehicle as it is driven over the gap between the aligned decks of the adjacent auto-rack cars with one bridge plate supporting the right side and the other bridge plate supporting the left side of the vehicle. The bridge plates are typically mounted to the auto-rack cars only during the loading and unloading of the vehicles. The Association of American Railroads (AAR) specifies a maximum weight, a minimum strength requirement, and a fatigue load for such bridge plates in AAR Specifications.

Each bridge plate is typically made of an aluminum plate and a steel locking assembly attached to the bottom of one end of the aluminum plate. Each bridge plate is pivotally attached by the locking assembly to one end of one auto-rack car and spans the gap to the deck of the adjacent auto-rack car. Each bridge plate is only attached to one of the adjacent auto-rack cars at one end so as to accommodate variable spacing between adjacent coupled auto-rack cars in the string or series of auto-rack cars that are undergoing loading or unloading. The end of the bridge plate that is the non-pivotally attached end of the bridge plate rests on the adjacent auto-rack car deck. The steel locking assembly of each bridge plate includes multiple outwardly extending pins (including a spring biased locking pin) that pivotally attach the bridge plate to one of the auto-rack cars. The locking assembly is connected to and can be accessed from the bottom side of the bridge plate.

One such known bridge plate locking assembly includes: (a) a support bracket; (b) a guide tube connected to the bottom of the support bracket; (c) a first slidable locking pin partially positioned in the guide tube; (d) a first handle integrally attached to the first slidable locking pin; (e) a second slidable locking pin positioned in the guide tube; (f) a second handle integrally attached to the second slidable locking pin and also integrally connected to first handle; (g) a pivot pin partially positioned in the guide tube and loosely attached to the guide tube by a rivet; (h) a collar journaled about to the second locking pin; and (i) a spring positioned in the guide tube between the collar and the pivot pin.

During use, installation, and/or removal of bridge plates that have such locking assemblies, the bridge plates and the locking assemblies thereof are often subjected to various forces. When a bridge plate is subjected to such forces, one or more components of the locking assembly of that bridge plate can be bent, cracked, or otherwise damaged. For example, in the known locking assembly described above, one or more of: (i) the guide tube; (ii) the first slidable locking pin; (iii) the second slidable locking pin; and (v) the pivot pin, often become bent or otherwise damaged. When this occurs, the locking assembly does not easily function, does not properly function, or does not function at all. In another example, the collar journaled about the second slidable locking pin can crack and then move with respect to the second slidable locking pin. When this occurs, the tension provided by the spring on the first and second locking pins is reduced and this know locking assembly does not easily function, does not properly function, or does not function at all.

This known locking assembly cannot be easily, quickly, or efficiently repaired because the first locking pin, the second locking pin, and the respective handles are welded to each other and thus cannot be readily removed from the guide tube. Thus, the entire locking assembly must be replaced or the entire bridge plate must be replaced.

The bridge plate locking assembly disclosed in U.S. Patent Publication No. 2017/0334463 addresses these problems, but in certain instances does not fully solve these problems.

Accordingly, there is thus a continuing need to solve these problems.

SUMMARY

Various embodiments of the present disclosure provide an auto-rack railroad car bridge plate locking assembly additionally solves the above locking pin problem by providing a locking pin that is easily and readily replaceable.

Various embodiments of the present disclosure provide an auto-rack railroad car bridge plate locking assembly including: (a) a support bracket configured to be connected to an auto-rack railroad car bridge plate; (b) a guide tube connected to the bottom of the support bracket; (c) a single slidable locking pin partially positioned in one end of the guide tube and partially extending from that end of the guide tube; (e) a handle assembly extending transversely from and removably attached to the locking pin; (f) a fixed pivot pin partially positioned in the opposite end of the guide tube, securely or fixedly connected to that opposite end of the guide tube, and partially extending from that end of the guide tube; and (g) a spring positioned in the guide tube between and abutting each of the fixed pivot pin and the slidable locking pin. The removable handle assembly and locking pin enable the locking pin to be replaced if the locking pin is bent during use, installation, or removal. The combination of these components enables the locking assembly of the present disclosure to be readily and efficiently repaired without the need to replace the entire locking assembly or the entire bridge plate.

Various embodiments of the present disclosure also provide an auto-rack railroad car bridge plate having the locking assembly described herein.

Other objects, features and advantages of the present invention will be apparent from the following detailed disclosure, taken in conjunction with the accompanying sheets of drawings, wherein like reference numerals refer to like parts.

DETAILED DESCRIPTION

Figure 1:
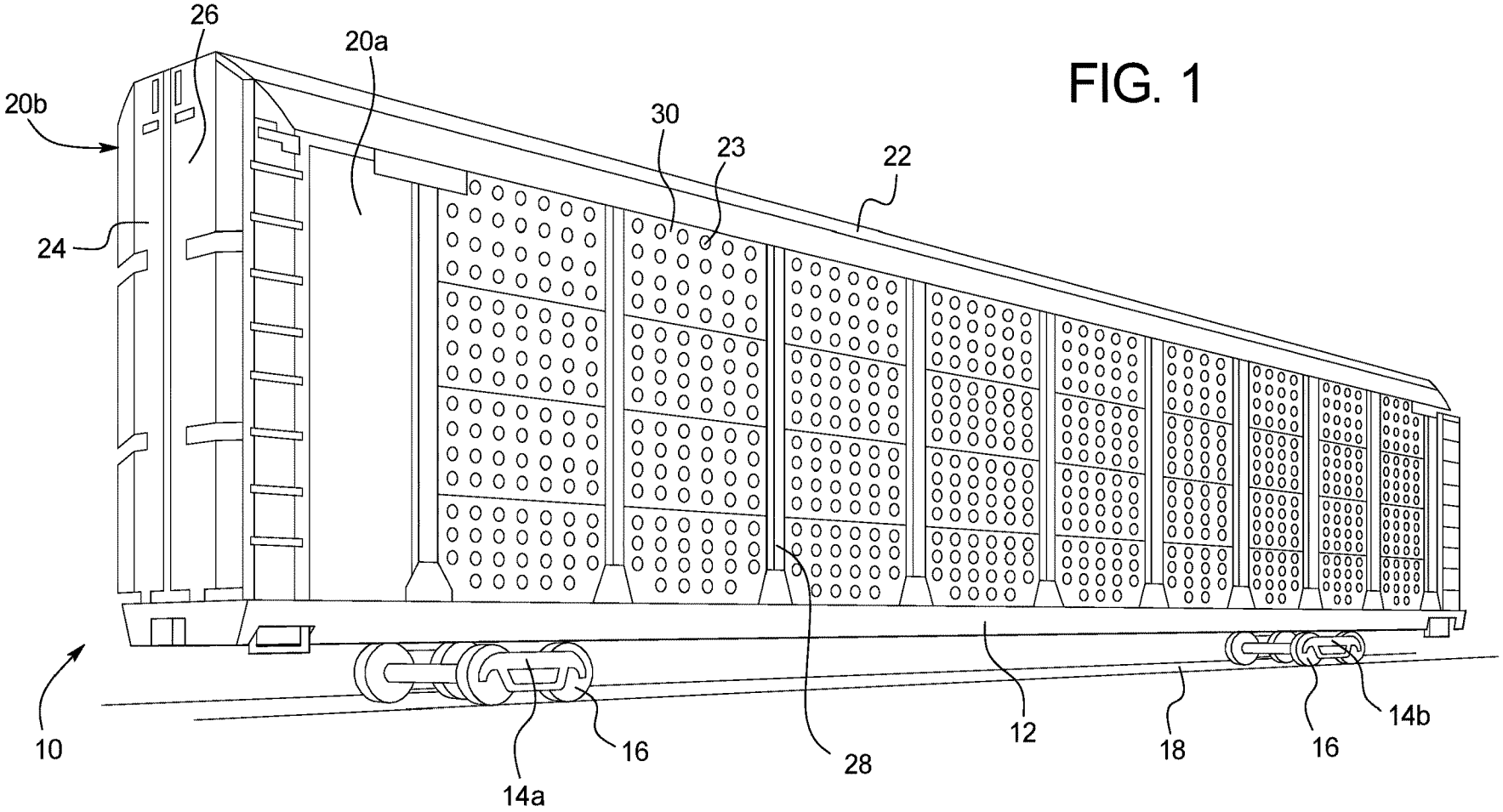
FIG. 1 is a side perspective view of an auto-rack railroad car configured to transport a plurality of vehicles.

Referring now to the drawings and particularly to FIG. 1, a typical auto-rack car 10 includes a frame 12 supported by trucks 14*a* and 14*b*, each of which has several wheels 16 configured to roll along conventional railroad tracks 18. The frame 12 supports two opposing sidewalls 20*a* and 20*b* and a roof 22. The auto-rack car 10 includes a pair of co-acting clamshell doors 24 and 26 mounted on each end of the auto-rack car 10. The doors 24 and 26 are opened to facilitate the loading and unloading of vehicles into and out of the auto-rack car 10 and are closed during transport or storage of the vehicles. It should be appreciated that the present disclosure can be employed on such auto-rack cars or otherwise configured auto-rack cars.

The sidewalls 20 include a series of steel vertical posts 28 that are mounted on and extend upwardly from the frame 12. The roof 22 is mounted on and supported by these vertical posts. The vertical posts are evenly spaced along the entire length of both sidewalls 20 of the auto-rack car 10. A plurality of rectangular galvanized steel side wall panels 30 that extend horizontally and are vertically spaced apart are mounted between each pair of vertical posts 28. These side wall panels are supported at their corners by brackets (not shown) that are suitably secured to the vertical posts. The average side wall panel has a multiplicity of round sidewall panel holes 23. These side wall panel holes 23 provide the auto-rack car with natural light as well as proper ventilation. Proper ventilation prevents harm from the toxic vehicle fumes to the person or persons (i.e., loaders) loading or unloading the vehicles into or out of the auto-rack car.

Figure 2A:
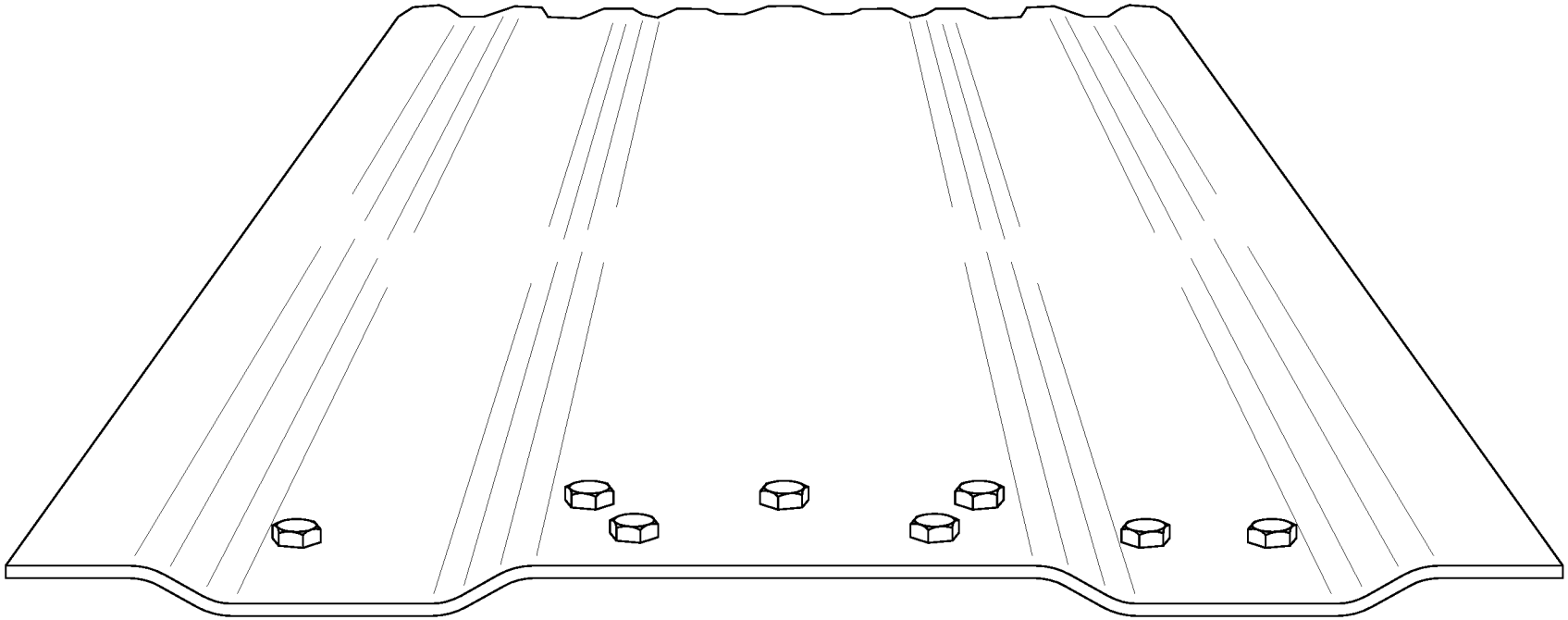
FIG. 2A is a top perspective view of an auto-rack railroad car bridge plate with the auto-rack railroad car bridge plate locking assembly of one example embodiment of the present disclosure attached thereto.
Figure 2B:
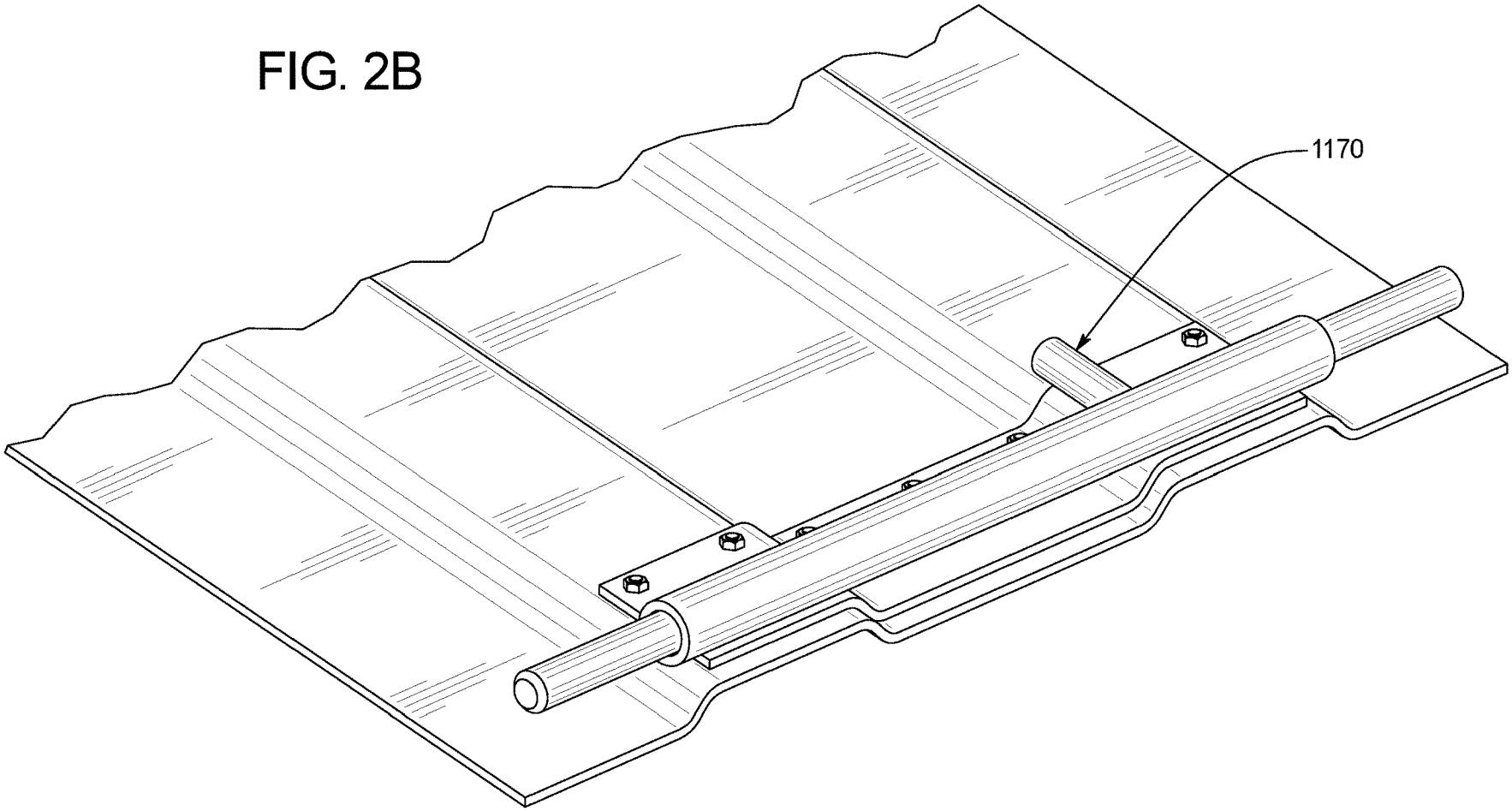
FIG. 2B is a bottom perspective view of the auto-rack railroad car bridge plate of FIG. 2A with the auto-rack railroad car bridge plate locking assembly of FIG. 2A attached thereto.
Figure 3A:
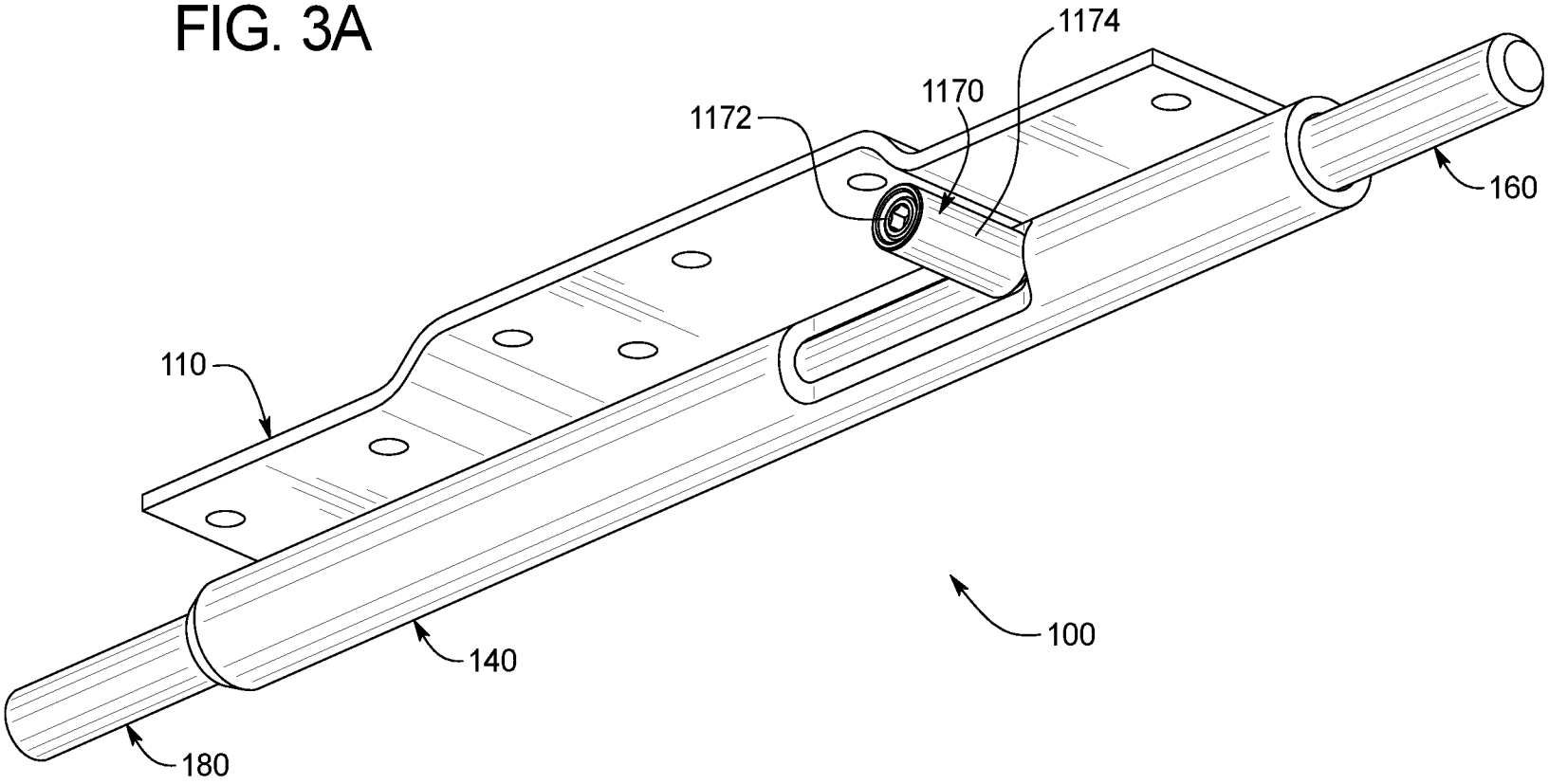
FIG. 3A is a bottom front perspective view of the auto-rack railroad car bridge plate locking assembly of FIGS. 2A and 2B.
Figure 3B:
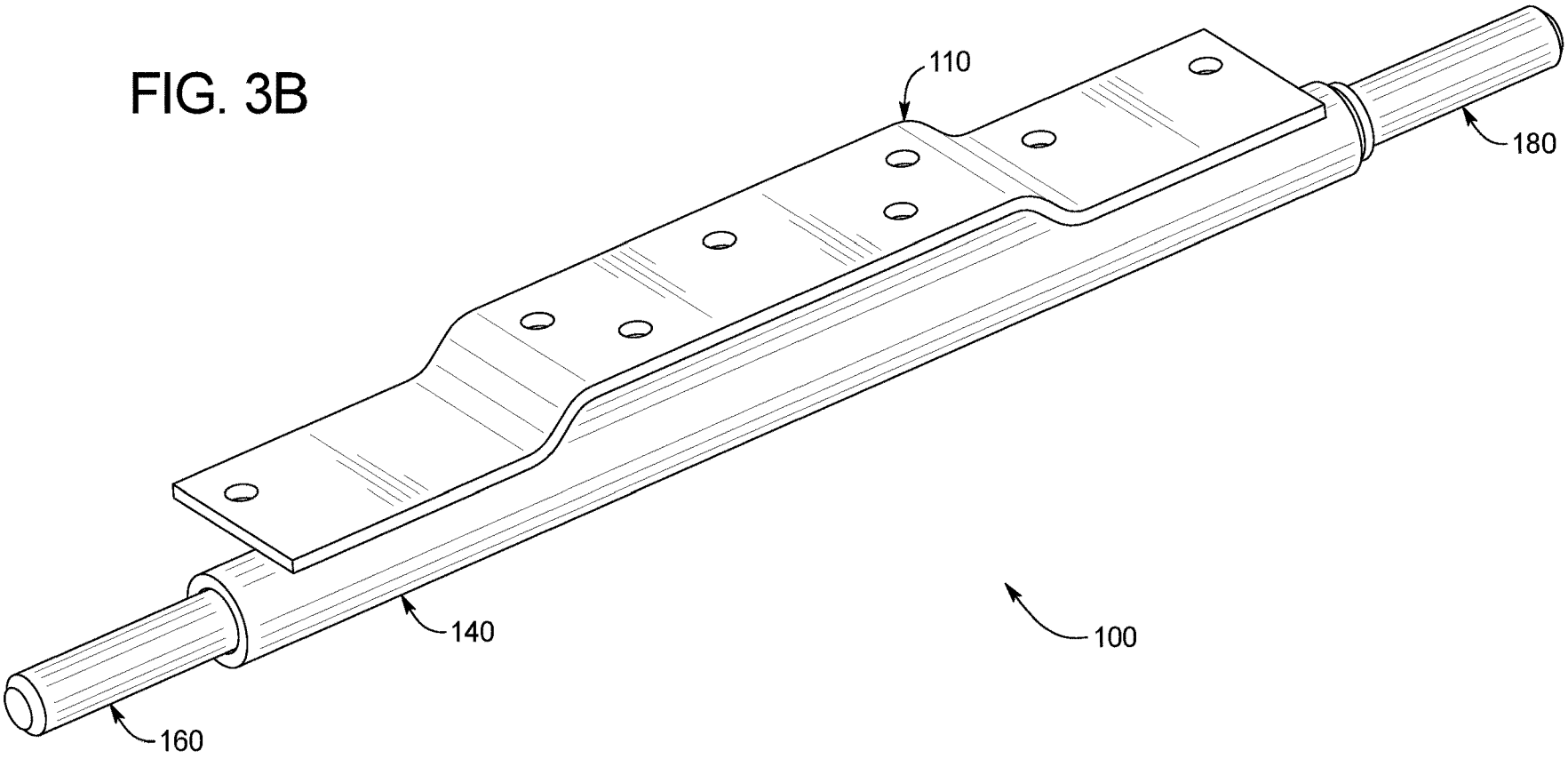
FIG. 3B is a rear top perspective view of the auto-rack railroad car bridge plate locking assembly of FIG. 3A.

Referring now to FIGS. 2A, 2B, 3A, 3B, 4, 5, 6, 7, 8, 9, 10, 11, 12, 13, and 14, the bridge plate locking assembly of one example embodiment of the present disclosure is generally illustrated and indicated by numeral 100. The bridge plate locking assembly 100 of the present disclosure is particularly configured for auto-rack cars (that have one or more levels or decks) such as auto-rack car 10. The auto-rack railroad car bridge plate locking assembly of the present disclosure is sometimes referred to herein for brevity as the locking assembly; such abbreviation is not meant to limit the present disclosure. FIGS. 2A and 2B generally show the bridge plate locking assembly 100 attached to a bottom of a bridge plate.

The auto-rack railroad bridge plate locking assembly 100 of various embodiments of the present disclosure generally includes a support bracket 110 configured to be attached to an auto-rack railroad car bridge plate, a guide tube 140 connected to the bottom of the support bracket 110, a slidable locking pin 160 partially positioned in a first end of the guide tube 140 and partially extending from the first end of the guide tube 140, a removable handle assembly 1170 removably attached to the locking pin 160, a fixed pivot pin 180 partially positioned in and securely connected to a second end of the guide tube 140 and partially extending from the second end of the guide tube 140, and a spring 190 positioned in the guide tube 140 between and abutting the fixed pivot pin 180 and the locking pin 160.

In this illustrated embodiment, the support bracket 110, the guide tube 140, the slidable locking pin 160, the removable handle assembly 1170, the locking pin 160, the fixed pivot pin 180, and the spring 190 are all made from suitable metals such as steel. It should be appreciated that one or more of these components of the locking assembly can be made from other suitable materials. It should also be appreciated that one or more of these components can be coated with a protective coating such as paint. It should also be appreciated that one or more of these components can be plated.

More specifically, in this illustrated embodiment, as best seen in FIGS. 3A, 3B, 4, 5, 6, and 7, the support bracket 110 includes an elongated body 111 including five integrally formed or connected sections, and particularly a first section 111*a*, a second section 111*b*, a third section 111*c*, a fourth section 111*d*, and a fifth section 111*e*. The first section 111*a* and the spaced apart fifth section 111*e* lie in the same plane. The third section 111*c* lies in a higher plane. The second section 111*b* is curved and connects the first section 111*a* to the third section 111*c*. Likewise, fourth section 111*d* is curved and connects the fifth section 111*e* to the third section 111*c*. The shapes of these sections generally correspond with the contour of the plate of the bridge plate to facilitate connection of the locking assembly 100 to the plate of the bridge plate. The openings 112*a* in the first section 111*a*, openings 112*b*, 112*c*, 112*d*, 112*e*, and 112*f* of the third section 111*c*, and the openings 112*g* and 112*h* in the fifth section 111*e* are employed for attaching the locking assembly 100 to the bridge plate by suitable fasteners (not shown) such as bolts and nuts (not shown).

In this illustrated embodiment, as best seen in FIGS. 3A, 3B, 4, 5, 8, and 9, the guide tube 140 includes an elongated hollow cylindrical body 141 that defines: (a) a central cylindrical lumen 142; (b) cylindrical openings 142*a* and 142*b* at opposite ends of the body 141; and (c) an oval elongated handle opening 146 extending part of the length of the side of the body 141. The central cylindrical lumen 142 and the cylindrical opening 142*a* are configured and sized such that the locking pin 160 is freely movable within the guide tube 140. The central cylindrical lumen 142 is also configured and sized such that the spring 190 is freely movable within the guide tube 140. The central cylindrical lumen 142 and the cylindrical opening 142*b* are configured and sized such that the fixed pivot pin 180 can be securely attached to the end of the body 141 that defines the opening 142*b*. The handle opening 146 is configured and sized such that part of the handle assembly 1170 extends through the opening 146 of the guide tube 140 and is moveable in the opening 146. In this illustrated embodiment, the top of the guide tube 140 is connected (by welding) to the bottom of the support bracket 110, and particularly to the bottom surfaces of sections 111*a* and 111*e* of the support bracket 110, in two spaced apart locations. In this illustrated embodiment, the guide tube is cylindrical; however, it should be appreciated that that the guide tube may be alternatively configured in accordance with the present disclosure.

In this illustrated embodiment, as best seen in FIGS. 3A, 3B, 4, 5, and 10, the slidable locking pin 160 includes an elongated solid cylindrical body 161 with a chamfered first end 162*a* and a flat spring engagement opposite end 162*b*. The slidable locking pin 160 is configured to be partially positioned in the first end of the guide tube 140 and partially extend from the first end of the guide tube 140. The slidable locking pin 160 defines a cylindrical threaded handle receiving opening 164 transversely extending through the entire body 161 from one side of the body 161 to the opposite side of the body 161. The cylindrical handle receiving opening 164 is configured and sized such that an attachment member 1172 of the handle assembly 1170 can be inserted into and threadably secured in and to the locking pin 160. The elongated solid cylindrical body 161 has an end section that is configured to be removably inserted in a locking pin receiver (not shown) on an auto-rack car as is known in the industry to removably attach a bridge plate (not shown) to an auto-rack car. In this illustrated embodiment, the slidable locking pin is cylindrical and solid; however, it should be appreciated that that the slideable locking pin may be alternatively configured in accordance with the present disclosure.

In this illustrated embodiment, as best seen in FIGS. 3A, 4, 5, 12, 13, and 14, the handle assembly 1170 includes the attachment member 1172, a gripping member 1174 journaled about the attachment member 1172, and a locking member 1175 journaled about the attachment member 1172. The attachment member 1172 and the locking member 1175 securely, but removably and rotatably, attach the gripping member 1174 to the locking pin 160.

More specifically, the gripping member 1174 includes a partially cylindrical and partially conical body. The body includes an outer portion 1182, an inner portion 1190, and a central portion 1186 between and integrally connected to and connecting the outer portion 1182 and the inner portion 1190. In this illustrated embodiment, the entire gripping member (including portions 1182, 1186, and 1190) is monolithically formed from a suitable metal such as steel. It should be appreciated that the gripping member 1174 can be made from other suitable materials in accordance with the present disclosure.

The outer portion 1182 is cylindrical and includes an outer cylindrical wall 1183 having an outer surface 1183*a* and an inner surface 1183*b*. The outer wall 1183 and specifically the inner surface 1183*ab* defines a central cylindrical first channel 1183*c* having a first inner diameter.

The central portion 1186 is cylindrical and includes an outer wall 1187 having an outer surface 1187*a* and an inner surface 1187*b*. The outer wall 1187 and specifically the inner surface 1187*b* defines a central cylindrical second channel 1187*c* having a second inner diameter. The second inner diameter is smaller than the first inner diameter in this illustrated example embodiment.

The inner portion 1190 is conical and includes a conical outer wall 1191 having an outer surface 1191*a* and an inner surface 1191*b*. The outer wall 1191 and specifically the inner surface 1191*b* defines a central cylindrical third channel 1191*c* having a third inner diameter. The third inner diameter is the same as the second inner diameter in this illustrated example embodiment. The third inner diameter is smaller than the first inner diameter in this illustrated example embodiment.

The first, second, and third channels 1183*c*, 1187*c*, and 1191*c* define an attachment member receiving channel configured to receive the attachment member 1172 such that the head 1192 of the attachment member 1172 is positioned in the first channel 1183*c*, the rest of the attachment member 1172 extends through the second and third channels 1187*c* and 1191*c*.

The attachment member 1172 includes an elongated body having an outer portion or head 1192, an inner or engagement portion 1200 and a central portion 1196 between and integrally connected to and connecting the outer portion 1192, and the inner portion 1200. In this illustrated example embodiment, the entire attachment member (including portions 1192, 1196 and 1200) is monolithically formed from a suitable metal such as steel. It should be appreciated that the attachment member can be made from outer suitable materials.

The outer portion or head 1192 is a solid cylindrical member except that it defines a mechanical engagement structure 1193. The cylindrical member has an outer surface (not labeled) having a first outer diameter. The first outer diameter of the head 1192 is smaller than the first inner diameter of the outer portion 1183 of the gripping member 1174 such that the head portion 1192 can be rotatably positioned in the outer portion 1183 of the gripping member 1174. The entire head 1192 also lengthwise fits in the outer portion 1183 of the gripping member 1174.

The mechanical engaging structure 1193 is engageable by an appropriate tool (not shown) for rotating the attachment member 1172. In this illustrated example embodiment of the present disclosure, the mechanical engaging structure 1193 includes a hexagonal shaped cavity defined by a plurality of walls that are engageable by an appropriate tool (such as engageable by an Allen wrench). In other embodiments of the present disclosure, other mechanical engaging structures may be utilized, such as a straight slot (engageable by a flathead screwdriver), or a cross-shaped slot (engageable by a Phillips head screwdriver). Any suitable mechanical engaging structure rotatable or drivable by a suitable tool may be employed as the engaging structure in accordance with the present disclosure.

The central portion 1196 of the attachment member 1172 is a solid cylindrical member (not labeled) and includes an outer surface (not labeled). The outer surface has a second outer diameter. The second outer diameter is smaller than the first outer diameter of the head 1192. The second outer diameter is also smaller than the second inner diameter of the central portion 1186 of the gripping member 1174 such that the center portion 1196 is rotatable in the gripping member 1174 during installation and removal.

The inner portion 1200 of the attachment member 1172 is also a solid cylindrical member (not labeled) and includes a threaded outer surface (not labeled). The outer surface has a third outer diameter. The third outer diameter is smaller than the first outer diameter of the head 1192 and slightly larger than the second outer diameter.

The inner portion 1200 is rotatable in the central portion and the inner portion of the gripping member 1174 during installation and removal. The inner portion and specifically the threads of the inner portion are configured to engage the threads of the locking pin 160 that define opening 164 to form a secure engagement with the locking pin 160.

This configuration enables the gripping member 1174 to be freely rotatable relative to the attachment member 1172 and the locking pin 160 during installation and removal. In this illustrated embodiment, after installation, the gripping member 1174 is fixed to the locking pin 160 by the attachment member 1172 and the locking member 1175 such that the gripping member 1174 is not freely rotatable. It should be appreciated that the locking member 1175 assists in facilitating this locked secure connection of the attachment member 1172 and the gripping member 1174 to the locking pin 160. It should also be appreciated that other suitable or additional suitable locking mechanisms may be employed in accordance with the present disclosure. For example, a liquid locking mechanism may also be applied to the threads of the attachment member 1172 to secure the attachment member to the locking ping 160.

It should further be appreciated that in other embodiments of the present disclosure, these components can be configured such that the gripping member is freely rotatable relative to the locking pin 160.

This configuration also enables the attachment member 1172 to be substantially protected by the gripping member 1174 from damage by objects.

The configuration also enables the conical inner portion 1190 of the gripping member 1174 to engage the wall of the tubular member 140 that defines opening 146 without causing substantial damage or wear to either such component.

It should be appreciated that the handle assembly may be alternatively configured and shaped in accordance with the present disclosure.

In this illustrated embodiment, as best seen in FIGS. 3A, 3B, 4, 5, and 11, the fixed pivot pin 180 includes an elongated solid body 181 having three integrally formed cylindrical sections including a first cylindrical section 182, an intermediate cylindrical section 183, and a third cylindrical section 184. The fixed pivot pin 180 is configured to be partially positioned in the second end of the guide tube 140 and to partially extend from the second end of the guide tube 140. More specifically, the first cylindrical section 182 is configured and specifically sized to be inserted in and fit in the second end of the guide tube 140 through opening 142*b*. The first section 182 defines a flat spring engagement end 182*a*. The third cylindrical section 184 includes a chamfered end 184*a* and is configured and specifically sized to extend from the end of the guide tube 140 and to be removably inserted in a pivot pin receiver (not shown) on an auto-rack car as is known in the industry to attach a bridge plate (not shown) to an auto-rack car. The intermediate cylindrical section 183 of the fixed pivot pin 180 has a greater circumference than the first cylindrical section 182 and the third cylindrical section 184, and is configured and specifically sized to be welded to the end of the guide tube 140 that forms the opening 142*b*. This provides a secure or fixed connection between the guide tube 140 and the fixed pivot pin 180. In this illustrated embodiment, the intermediate cylindrical section 183 of the fixed pivot pin 180 has a central cylindrical surface, a tapered outer surface, and a transverse flat inner surface. In this illustrated embodiment, the pivot pin is machined to specific tolerances to securely fit in the guide tube 140 and the pivot pin receiver (not shown) on an auto-rack car. In this illustrated embodiment, the pivot pin is generally solid and includes cylindrical sections; however, it should be appreciated that the pivot pin may be alternatively configured in accordance with the present disclosure. In this illustrated embodiment, the pivot pin is suitably welded to the guide tube 140, but could be otherwise suitably securely attached such that it does not move relative to the guide tube.

Figure 4:
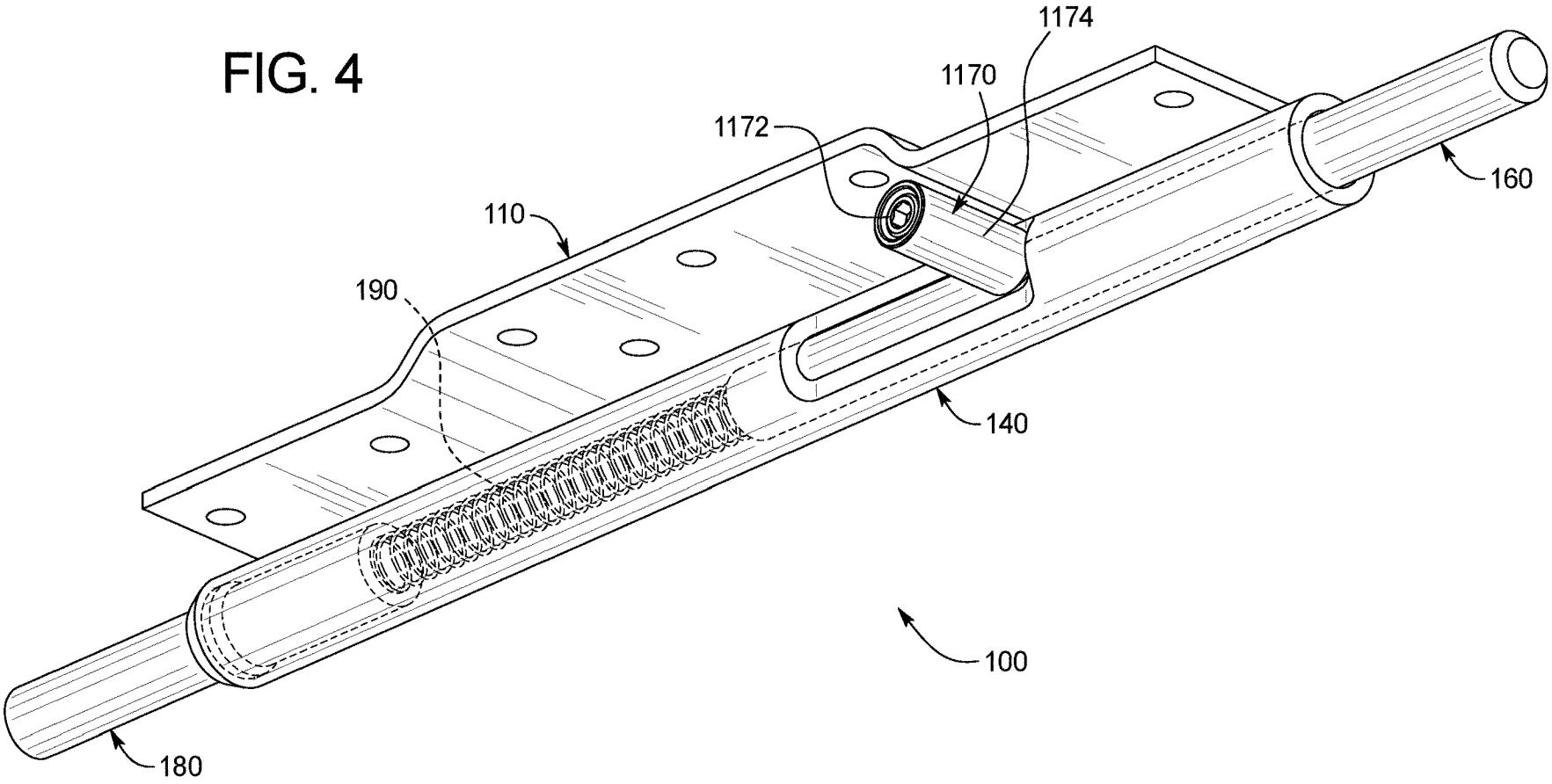
FIG. 4 is a bottom front perspective view of the auto-rack railroad car bridge plate locking assembly of FIGS. 3A and 3B, with the guide tube shown in phantom to illustrate the components in the guide tube.
Figure 5:
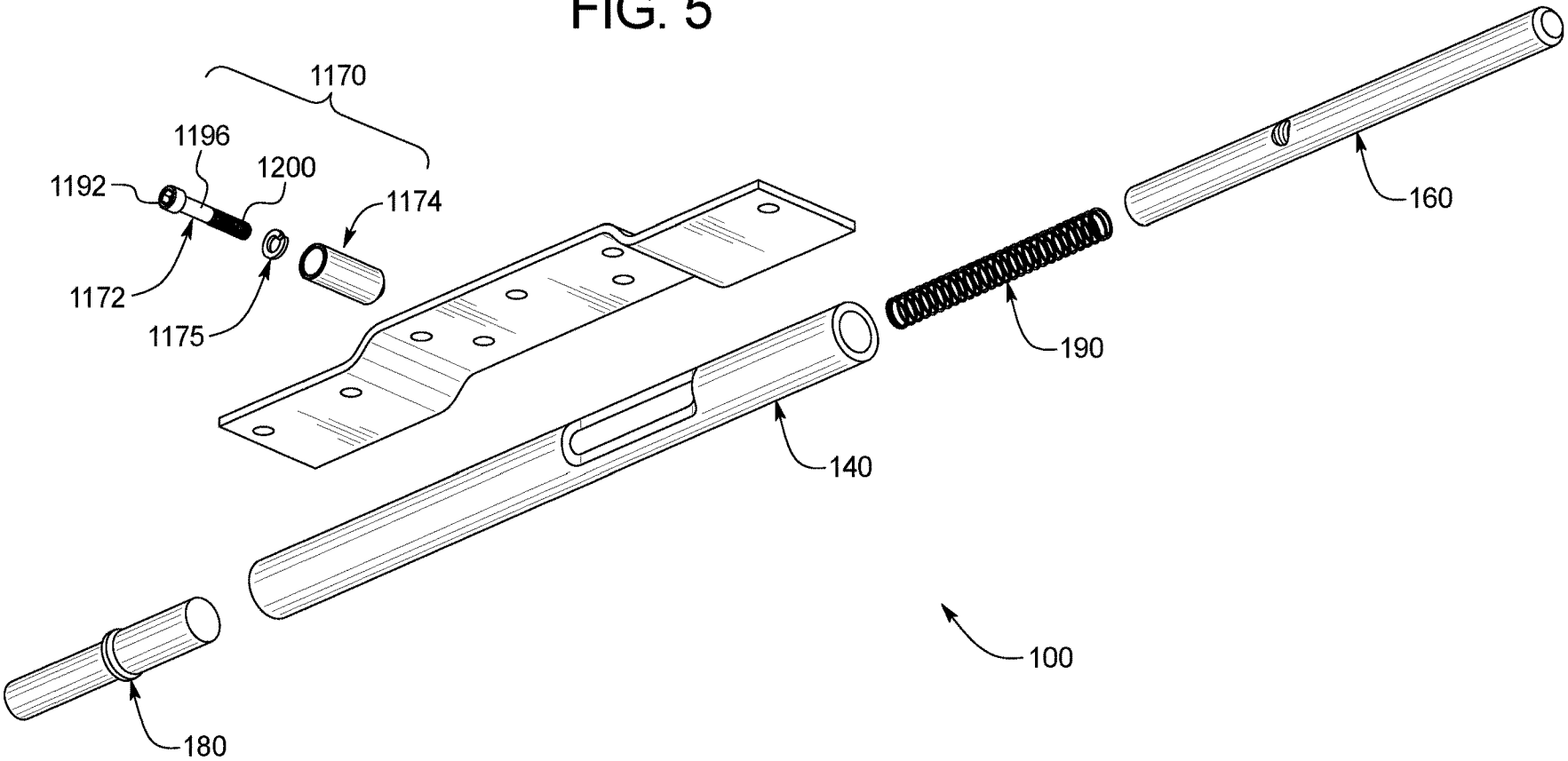
FIG. 5 is a bottom exploded perspective view of the auto-rack railroad car bridge plate locking assembly of FIGS. 3A and 3B.
Figure 6:
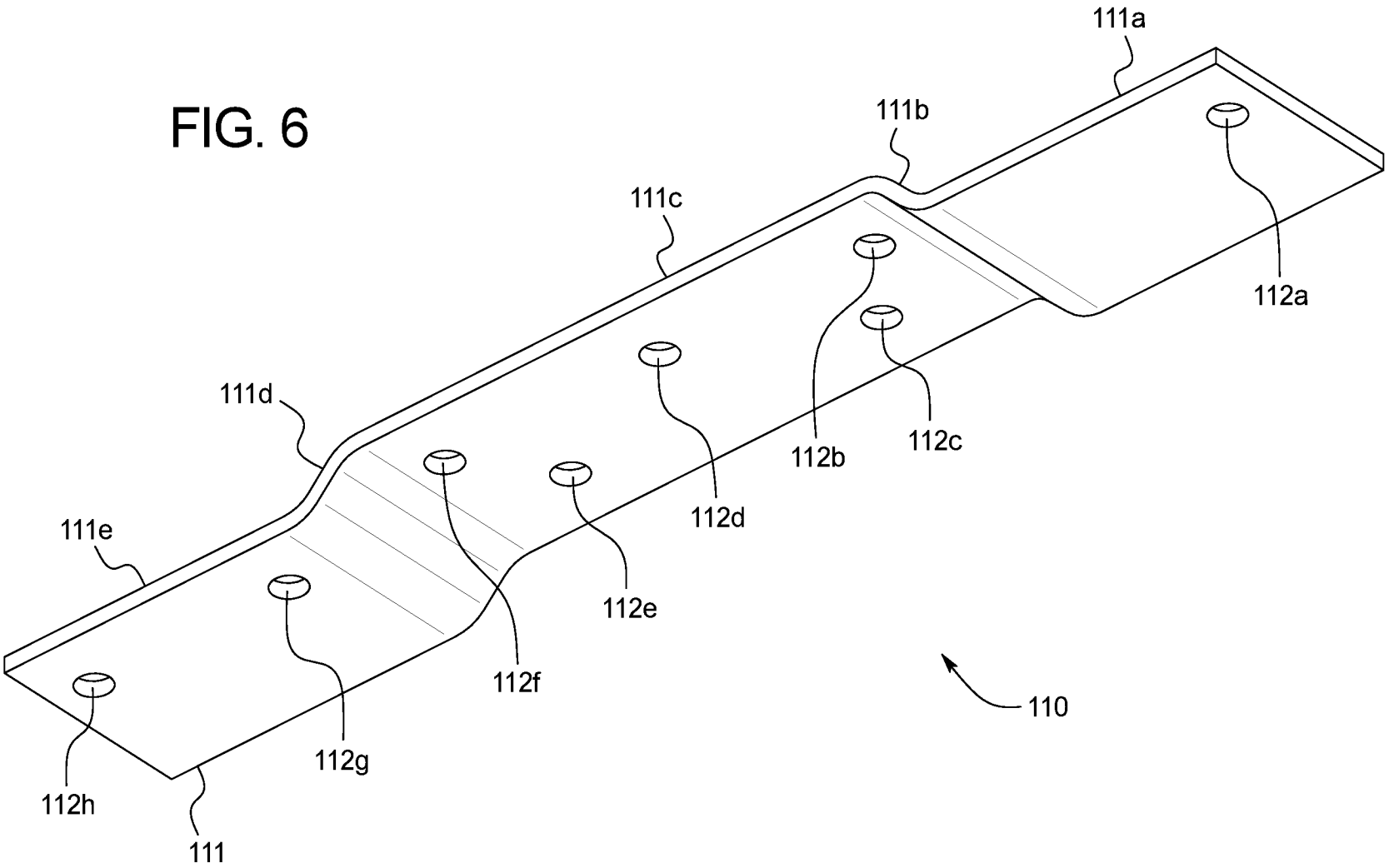
FIG. 6 is an enlarged bottom front perspective view of the support bracket of the auto-rack railroad car bridge plate locking assembly of FIGS. 3A and 3B.
Figure 7:
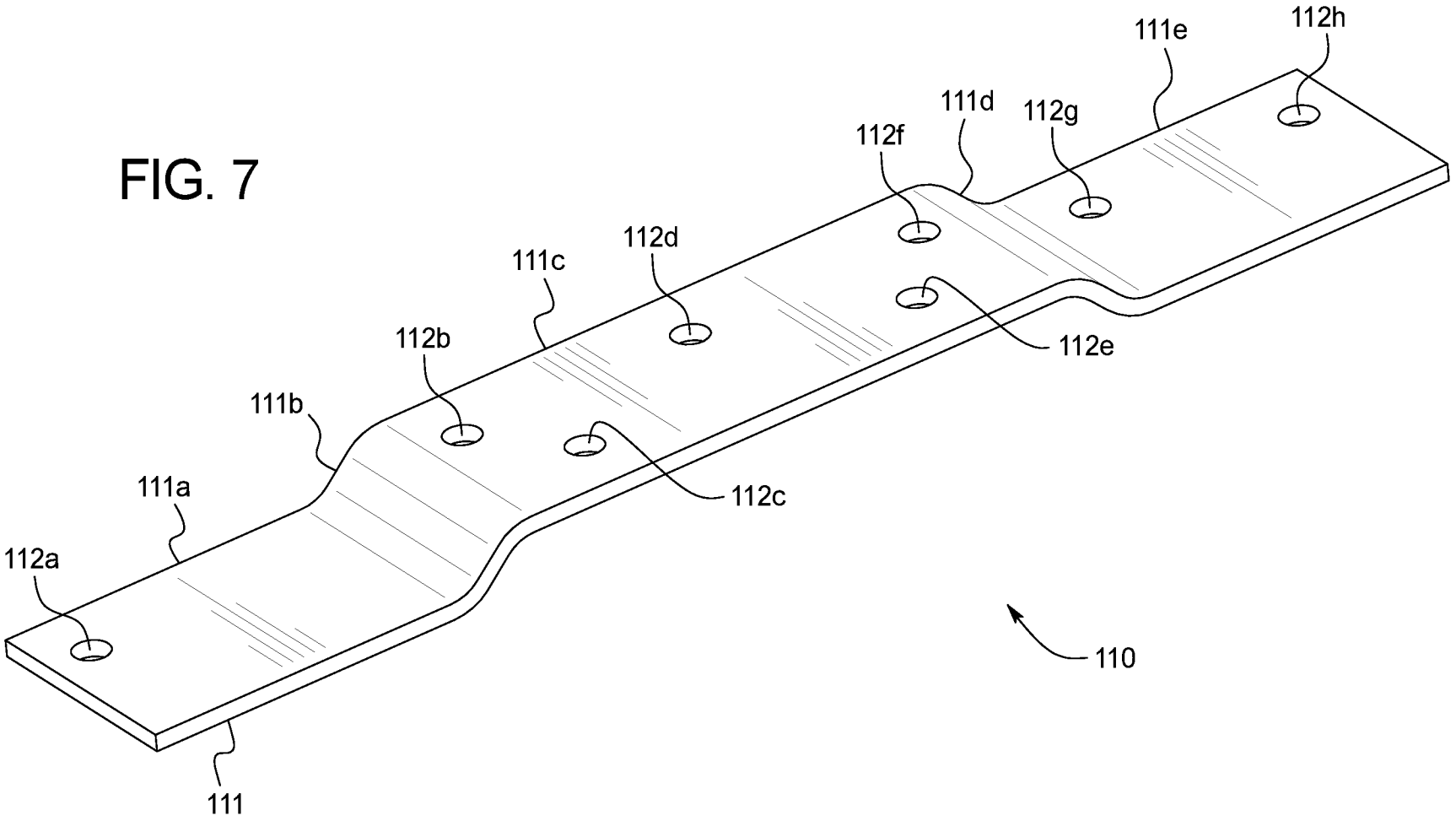
FIG. 7 is an enlarged top rear perspective view of the support bracket of the auto-rack railroad car bridge plate locking assembly of FIGS. 3A and 3B.
Figure 8:
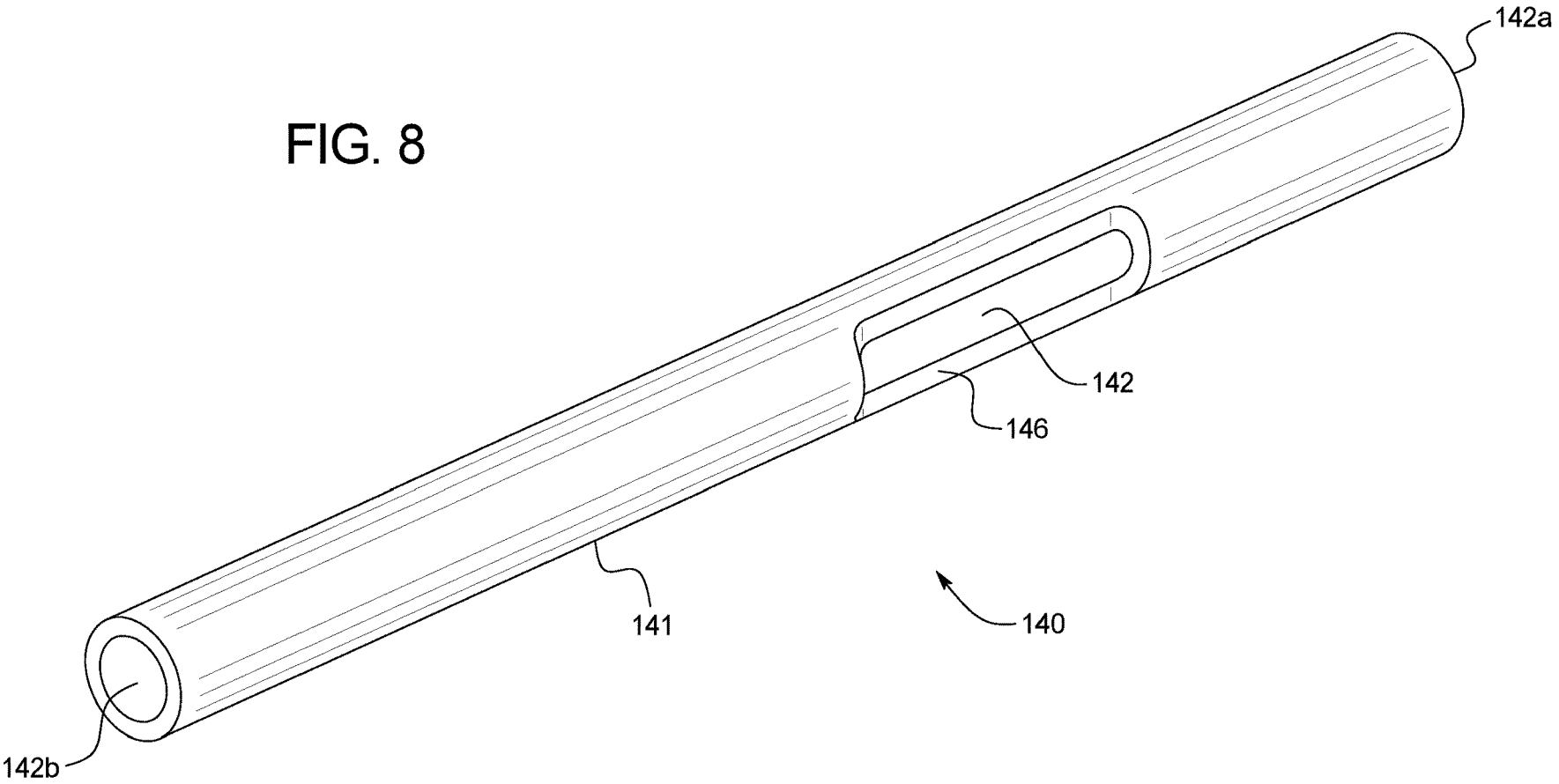
FIG. 8 is an enlarged top front perspective view of the guide tube of the auto-rack railroad car bridge plate locking assembly of FIGS. 3A and 3B.
Figure 9:
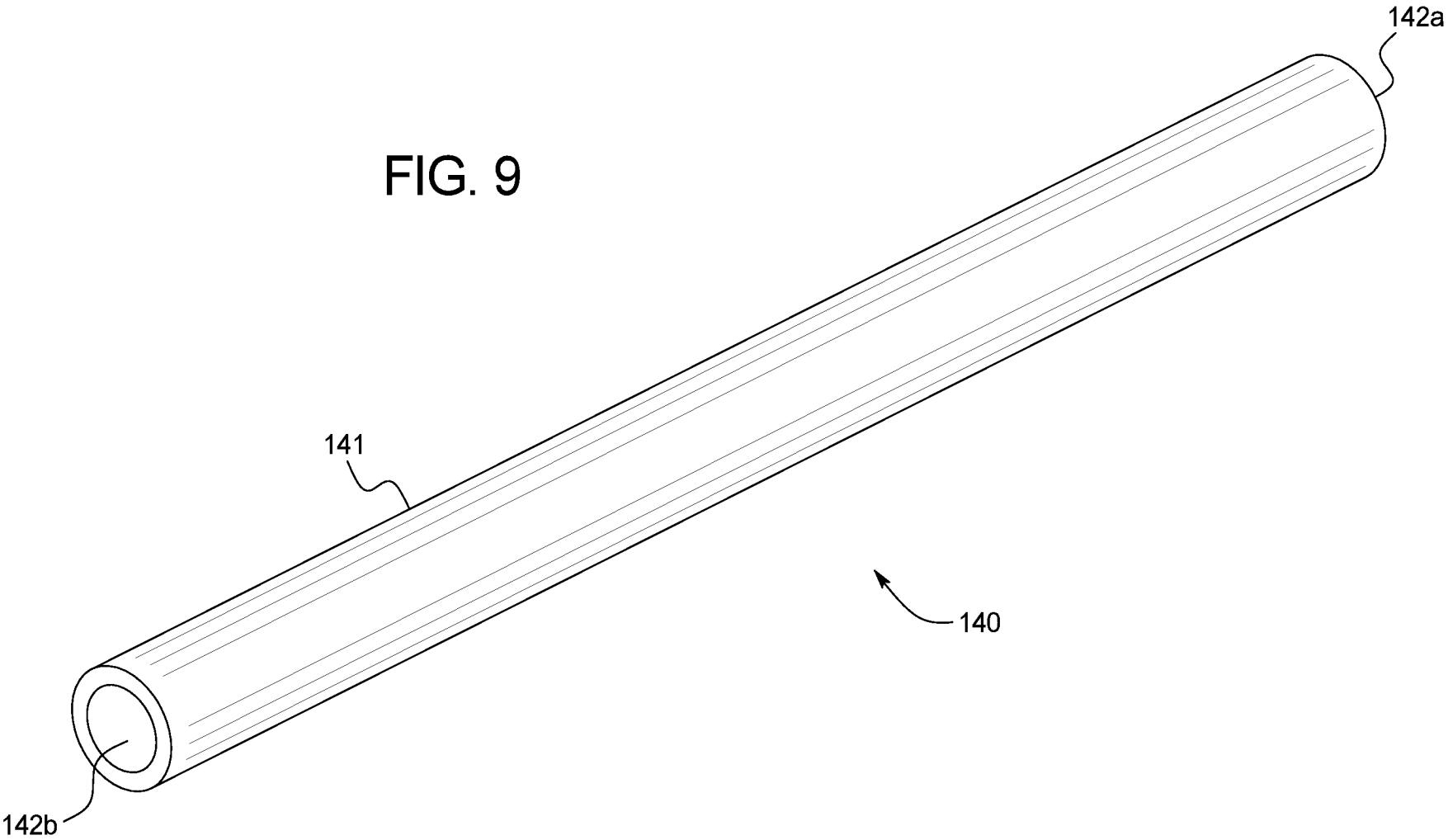
FIG. 9 is an enlarged top rear perspective view of the guide tube of the auto-rack railroad car bridge plate locking assembly of FIGS. 3A and 3B.
Figure 10:
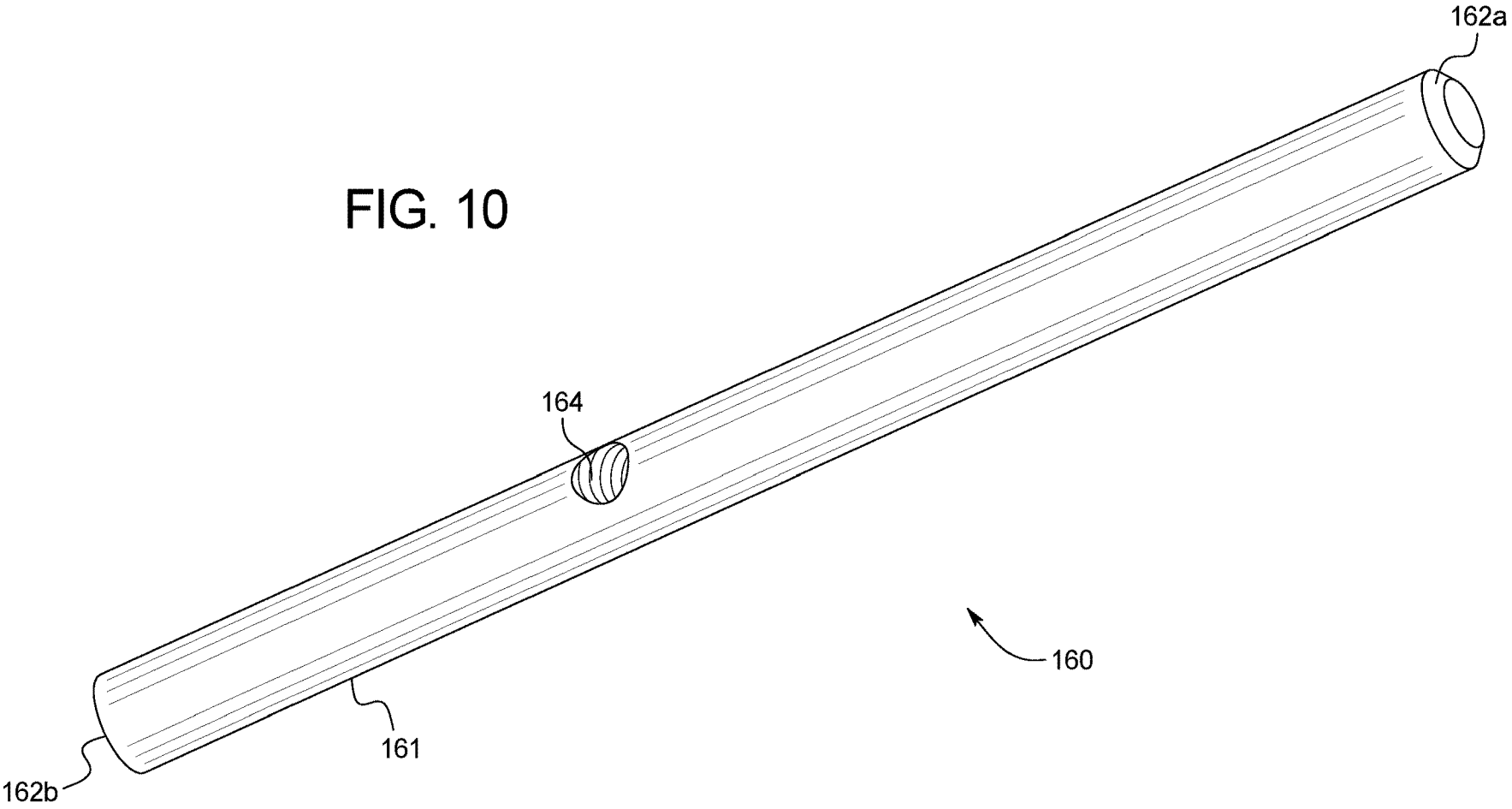
FIG. 10 is an enlarged bottom front perspective view of the locking pin of the auto-rack railroad car bridge plate locking assembly of FIGS. 3A and 3B.
Figure 11:
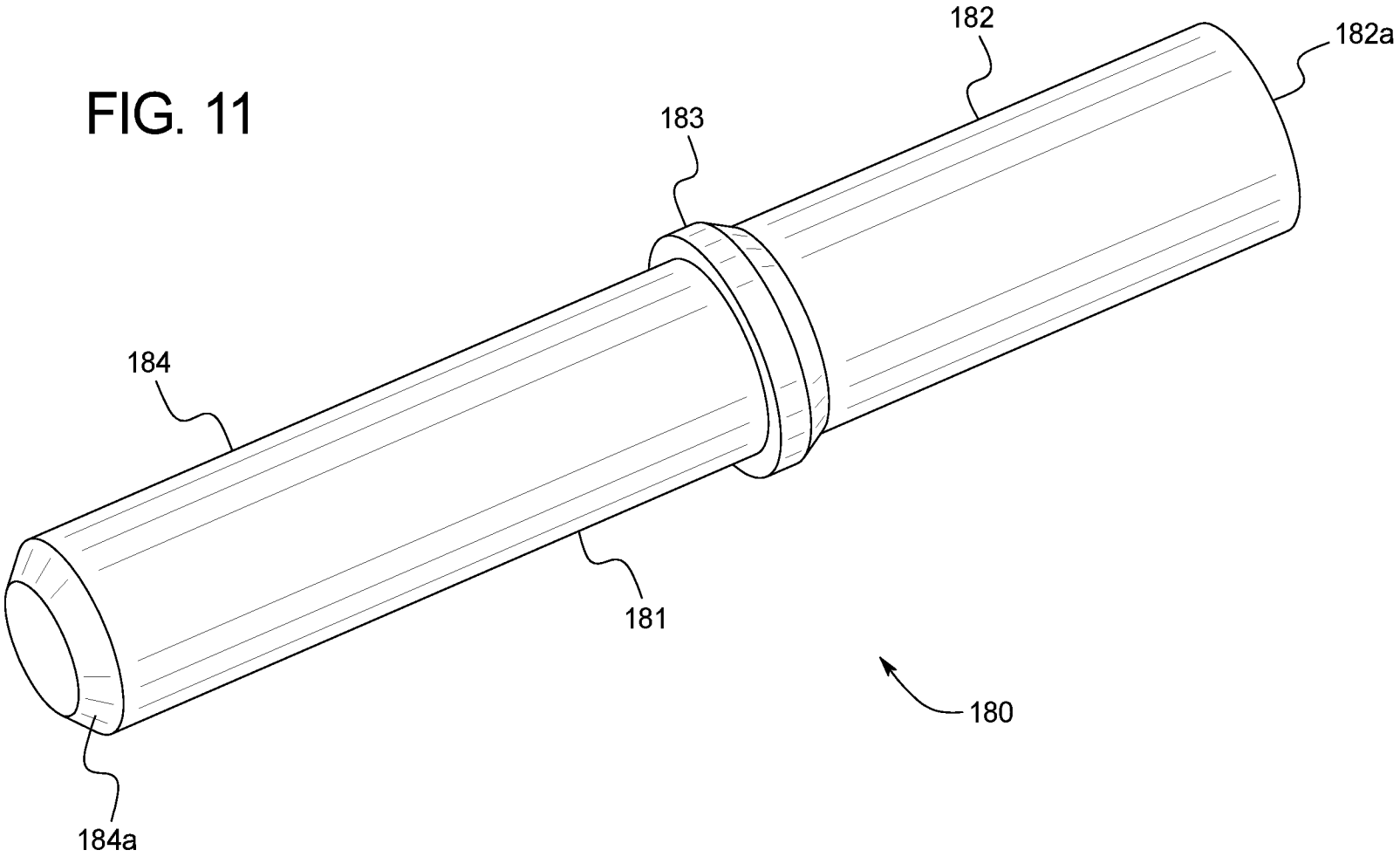
FIG. 11 is an enlarged bottom perspective view of the fixed pivot pin of the auto-rack railroad car bridge plate locking assembly of FIGS. 3A and 3B.
Figure 12:
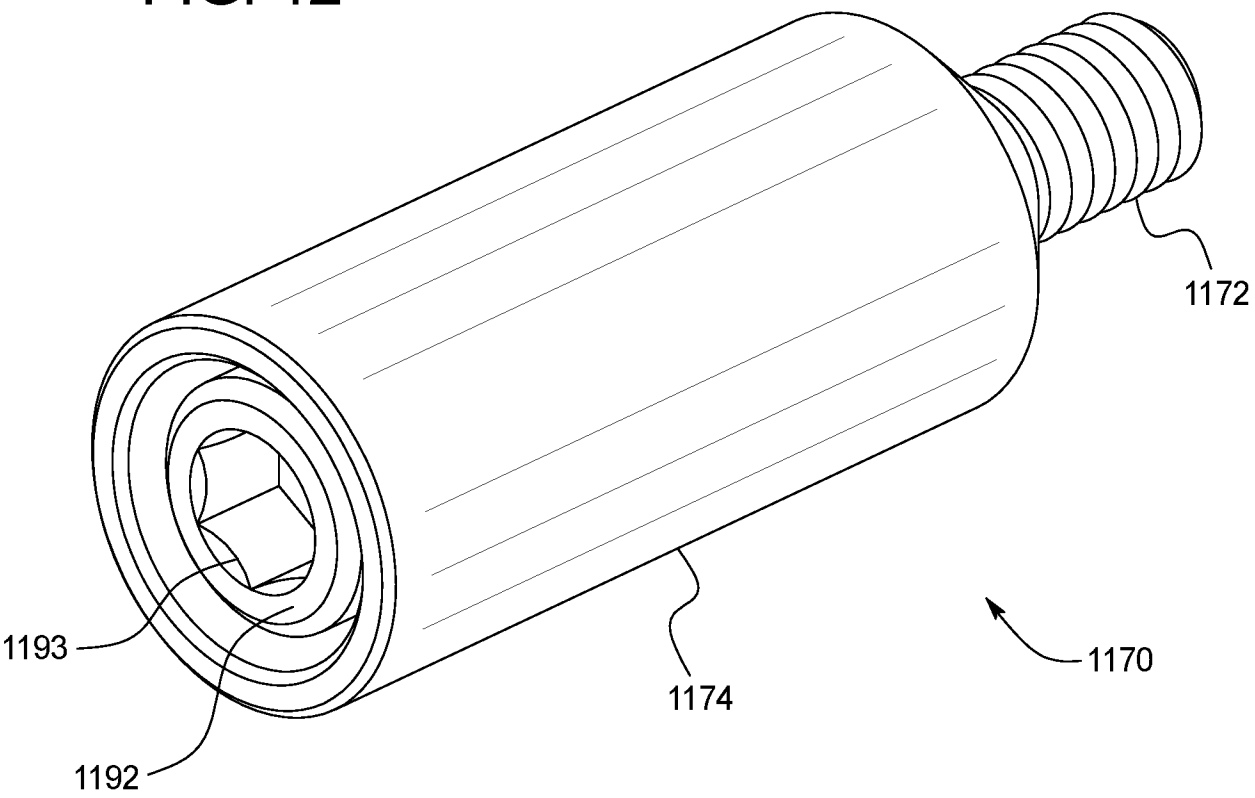
FIG. 12 is an enlarged top perspective view of the handle assembly of the auto-rack railroad car bridge plate locking assembly of FIGS. 3A and 3B.
Figure 13:
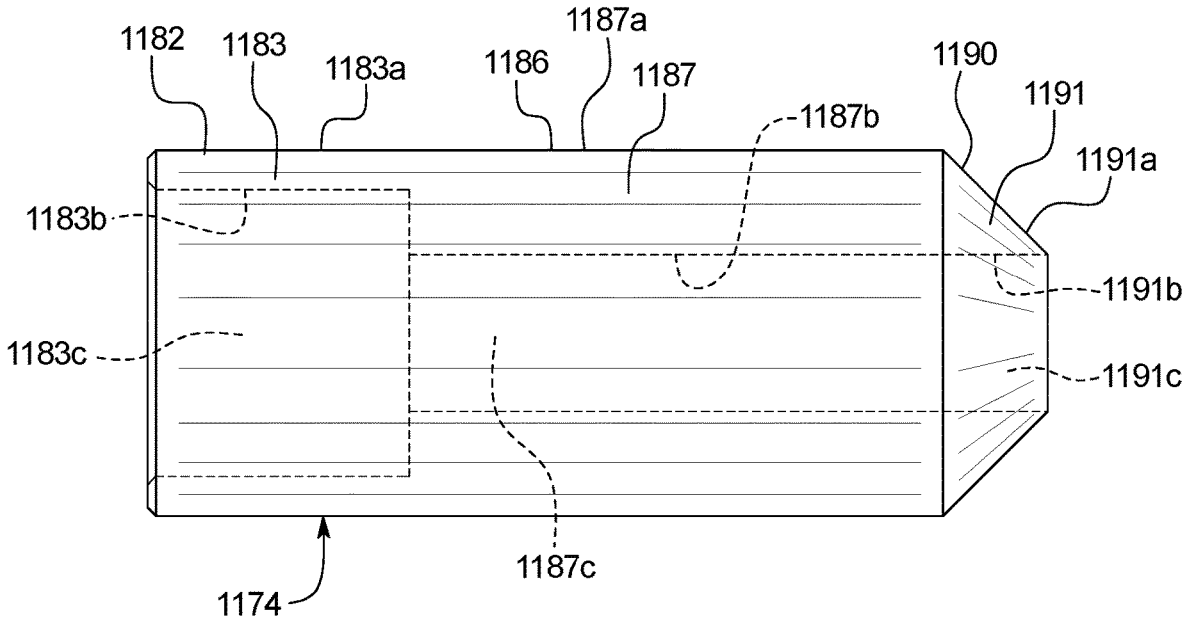
FIG. 13 is an enlarged side view of the gripping member of the handle assembly of the auto-rack railroad car bridge plate locking assembly of FIGS. 3A and 3B, showing the interior channels thereof in phantom.
Figure 14:
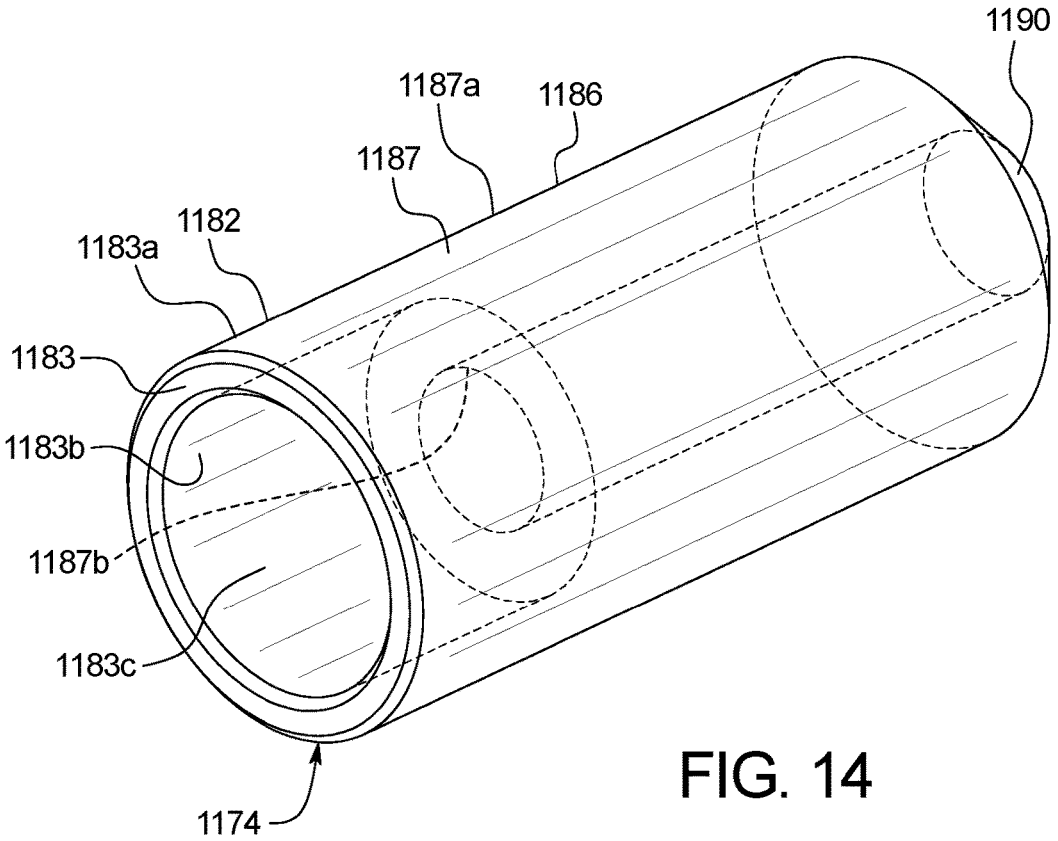
FIG. 14 is an enlarged top perspective view of the gripping member of the handle assembly of the auto-rack railroad car bridge plate locking assembly of FIGS. 3A and 3B, showing the interior channels thereof in phantom.

In this illustrated embodiment, as best seen in FIGS. 4 and 5, the spring 190 is a coil spring configured and sized to be positioned in the guide tube 140 between the fixed pivot pin 180 and the locking pin 160. The spring 190 has a first end configured to engage or butt up against the flat spring engagement opposite end 162*b* of the slidable locking pin 160 and an opposite second end configured to engage or butt up against the flat spring engagement end 182*a* of the first section 182 of the fixed pivot pin 180. The spring 190 is configured and sized to apply a biasing force against the locking pin 160 to push the locking pin 160 outwardly from the first end of the guide tube 140. In this illustrated embodiment, the spring is cylindrical; however, it should be appreciated that the spring may be alternatively configured in accordance with the present disclosure.

In this illustrated embodiment, to assemble the bridge plate locking assembly 100: (a) the guide tube 140 is welded to the bottom of the first section 111*a* of the support bracket 110 and to the bottom of the fifth section 111*e* of the support bracket 110; (b) the first section 182 of the fixed pivot pin 180 is inserted into the second end of the guide tube 140 and the intermediate section 183 is welded to that second end of the guide tube 140; (c) the spring 190 is inserted into the guide tube 140 through the first end of the guide tube 140; (d) the locking pin 160 is inserted into the first end of the guide tube 140; and (e) the attachment member 1172 of the handle 1170 is inserted through the gripping member 1174 the handle opening 146 in the guide tube 140 and into the handle receiving opening 164 of locking pin 160. It should be appreciated that the order of assembly may vary in accordance with the present disclosure.

If the locking pin 160 is bent or damaged in use or otherwise, the locking pin 160 can be replaced. In this illustrated embodiment, to replace the locking pin 160, the handle assembly 1170 is removed. Specifically, the attachment member 1172 and the locking member 1175 are detached from the gripping member 1174 and the locking pin 160.

In this illustrated embodiment, to replace the locking pin 160, the handle assembly 1170 is removed. After the handle assembly 1170 is removed from the locking pin 160, the locking pin 160 can be removed from the guide tube 140. A new locking pin 160 can then be inserted into the guide tube 140. The handle assembly 1170 can then be reattached to the locking pin 160 (or replaced if needed).

It should thus be appreciated that the removable handle assembly and the locking pin enable the locking pin to be replaced if the locking pin is bent during use, installation, or removal. The combination of these components enables the locking assembly to be readily and efficiently repaired without the need to replace the entire locking assembly or entire bridge plate.

It should also be appreciated from the above that that the auto-rack railroad car bridge plate locking assembly of the present disclosure eliminates the need for a collar (described above), and thus in various embodiments does not include such a collar.

It should also be appreciated from the above that that the auto-rack railroad car bridge plate locking assembly of the present disclosure provides a pivot pin that is securely attached to the guide tube, eliminates the need for a loosely attached pivot pin (described above), and thus in various embodiments does not include such a loosely attached pivot pin.

Various embodiments of the present disclosure also provide an auto-rack railroad car bridge plate with the locking assembly described above.

It should be understood that modifications and variations may be effected without departing from the scope of the novel concepts of the present invention, and it should be understood that this application is to be limited only by the scope of the claims.

The invention is claimed as follows:

1. An auto-rack railroad car bridge plate locking assembly comprising:

(a) a support bracket;

(b) a guide tube connected to the support bracket;

(c) a slidable locking pin partially positioned in and slidable within the guide tube;

(d) a handle assembly removably attached to the locking pin, the handle assembly including a gripping member and an attachment member that extends through the gripping member and that is threadably and rotatably attached to the locking pin;

(e) a pivot pin partially positioned in and connected to the guide tube; and (f) a spring positioned in the guide tube between the pivot pin and the locking pin, said spring configured to apply a biasing force against the locking pin to push the locking pin to slide in an outward direction away from the pivot pin in the guide tube so that the slidable locking pin with the handle assembly removably attached thereon is urged by said spring to move in the outward direction.

2. The auto-rack railroad car bridge plate locking assembly of claim 1, wherein: the slidable locking pin defines a cylindrical threaded handle attachment member receiving opening.

3. The auto-rack railroad car bridge plate locking assembly of claim 1, wherein the gripping member is not freely rotatable relative to the attachment member and the locking pin after installation.

4. The auto-rack railroad car bridge plate locking assembly of claim 1, wherein the attachment member includes an elongated body having a head that defines a mechanical engagement structure, a threaded inner portion, and a central portion between and integrally connected to and connecting the head and the inner portion, wherein the head has a first outer diameter, the central portion has a second outer diameter, and the inner portion has a third outer diameter, wherein the first outer diameter is greater than the second outer diameter and the third outer diameter.

5. The auto-rack railroad car bridge plate locking assembly of claim 4, wherein the gripping member includes a partially cylindrical and partially conical body.

6. The auto-rack railroad car bridge plate locking assembly of claim 5, wherein the gripping member includes a cylindrical outer portion, a conical inner portion, and a cylindrical central portion between and integrally connected to and connecting the outer portion and the inner portion.

7. The auto-rack railroad car bridge plate locking assembly of claim 6, wherein the outer portion of the gripping member includes an inner surface that defines a central cylindrical first channel and has a first inner diameter that is larger than the first outer diameter of the head of the attachment member.

8. The auto-rack railroad car bridge plate locking assembly of claim 7, wherein the central portion of the gripping member includes an inner surface that defines a central cylindrical second channel and has a second inner diameter that is larger than the second outer diameter of the central portion of the attachment member.

9. The auto-rack railroad car bridge plate locking assembly of claim 8, wherein the inner portion of the gripping member includes an inner surface that defines a central cylindrical third channel and has a third inner diameter that is larger than the third outer diameter of the inner portion of the attachment member.

10. The auto-rack railroad car bridge plate locking assembly of claim 1, wherein the gripping member includes a partially cylindrical and partially conical body.

11. The auto-rack railroad car bridge plate locking assembly of claim 10, wherein the gripping member includes a cylindrical outer portion, a conical inner portion, and a cylindrical central portion between and integrally connected to and connecting the outer portion and the inner portion.

12. An auto-rack railroad car bridge plate comprising:

a plate configured to extend from one auto-rack railroad car to an adjacent auto-rack railroad car; and a locking assembly connected to the plate and configured to pivotally attach the plate to one of the auto-rack rail road cars, said locking assembly including:

(a) a support bracket having first and second sections that are spaced apart from one another and lie on a same plane, and a third section disposed between the first and second sections and lying on a different plane than the same plane of the first and second sections, wherein the first and second sections are connected to respective side edges of the third section by respective curved sections;

(b) a guide tube connected to at least the first and second sections of the support bracket, the guide tube comprising an elongated hollow cylindrical body defining an elongated handle opening extending part of the length of a side of the body;

(c) a slidable locking pin partially positioned in and slidable within the guide tube;

(d) a handle assembly removably attached to the locking pin through the elongated handle opening, the handle assembly including a gripping member and an attachment member that extends from the gripping member and that is threadably and rotatably attached to the locking pin;

(e) a pivot pin partially positioned in and connected to the guide tube; and (f) a spring positioned in the guide tube between the pivot pin and the locking pin, said spring configured to apply a biasing force against the locking pin to push the locking pin to slide in an outward direction away from the pivot pin in the guide tube so that the slidable locking pin with the handle assembly removably attached thereon is urged by said spring to move in the outward direction;

wherein the slidable locking pin defines a cylindrical threaded opening, the handle attachment member threadably received in the cylindrical threaded opening.

13. The auto-rack railroad car bridge plate of claim 12, wherein the gripping member is not freely rotatable relative to the attachment member and the locking pin after installation.

14. The auto-rack railroad car bridge plate of claim 12, wherein the attachment member includes an elongated body having a head that defines a mechanical engagement structure, a threaded inner portion, and a central portion between and integrally connected to and connecting the head and the inner portion, wherein the head has a first outer diameter, the central portion has a second outer diameter, and the inner portion has a third outer diameter, wherein the first outer diameter is greater than the second outer diameter and the third outer diameter.

15. The auto-rack railroad car bridge plate of claim 14, wherein the gripping member includes a partially cylindrical and partially conical body.

16. The auto-rack railroad car bridge plate of claim 15, wherein the gripping member includes a cylindrical outer portion, a conical inner portion, and a cylindrical central portion between and integrally connected to and connecting the outer portion and the inner portion.

17. The auto-rack railroad car bridge plate of claim 16, wherein the outer portion of the gripping member includes an inner surface that defines a central cylindrical first channel and has a first inner diameter that is larger than the first outer diameter of the head of the attachment member.

18. The auto-rack railroad car bridge plate of claim 17, wherein the central portion of the gripping member includes an inner surface that defines a central cylindrical second channel and has a second inner diameter that is larger than the second outer diameter of the central portion of the attachment member.

19. The auto-rack railroad car bridge plate of claim 18, wherein the inner portion of the gripping member includes an inner surface that defines a central cylindrical third channel and has a third inner diameter that is larger than the third outer diameter of the inner portion of the attachment member.

20. The auto-rack railroad car bridge plate of claim 12, wherein the gripping member includes a partially cylindrical and partially conical body.

21. The auto-rack railroad car bridge plate of claim 20, wherein the gripping member includes a cylindrical outer portion, a conical inner portion, and a cylindrical central portion between and integrally connected to and connecting the outer portion and the inner portion.

* * * * *